US006881235B2

(12) United States Patent
May

(10) Patent No.: US 6,881,235 B2
(45) Date of Patent: Apr. 19, 2005

(54) METHOD OF REDUCING SMOKE AND PARTICULATE EMISSIONS FROM SPARK-IGNITED RECIPROCATING ENGINES OPERATING ON LIQUID PETROLEUM FUELS

(76) Inventor: Walter R. May, 800 Country Place Dr., #1305, Houston, TX (US) 77055-5559

( * ) Notice: Subject to any disclaimer, the term of this patent is extended or adjusted under 35 U.S.C. 154(b) by 0 days.

(21) Appl. No.: 10/417,547

(22) Filed: Apr. 17, 2003

(65) Prior Publication Data

US 2003/0196371 A1 Oct. 23, 2003

Related U.S. Application Data

(60) Provisional application No. 60/373,249, filed on Apr. 17, 2002.

(51) Int. Cl.[7] ..... C10L 1/18; C10L 1/30
(52) U.S. Cl. ..... 44/363; 44/373; 44/450
(58) Field of Search ..... 44/358, 359, 361, 44/362, 363, 365, 373, 450

(56) References Cited

U.S. PATENT DOCUMENTS

| | | | | | |
|---|---|---|---|---|---|
| 3,615,292 A | | | 10/1971 | Badin | |
| 3,891,401 A | | | 6/1975 | Watson et al. | |
| 4,505,718 A | | * | 3/1985 | Dorer, Jr. | 44/363 |
| 4,659,338 A | | * | 4/1987 | Johnston et al. | 44/347 |
| 4,690,687 A | | * | 9/1987 | Johnston et al. | 44/373 |
| 5,145,488 A | | * | 9/1992 | Weber et al. | 44/363 |
| 6,488,725 B1 | | * | 12/2002 | Vincent et al. | 44/358 |

FOREIGN PATENT DOCUMENTS

| | | | |
|---|---|---|---|
| CN | 1184146 | * | 6/1998 |
| CN | 1222561 | * | 7/1999 |
| GB | 2090291 A | * | 7/1982 |
| GB | 2248068 A | * | 3/1992 |

OTHER PUBLICATIONS

Rising, B., Particulate Emission Reduction Using Additives, Technical Paper TP–98010, Jan. 9, 1998, Westinghouse Power Corp., Orlando, FL 32826–2399.

Dr. Walter May, Combustion Turbine Exhaust Particulate Emission Reduction: A Mechanistic Discussion, dated Jun. 2002.

* cited by examiner

*Primary Examiner*—Cephia D. Toomer

(57) ABSTRACT

A method of reducing smoke and particulate emissions from an exhaust gas from a spark-ignited reciprocating engine by adding a fuel additive which contains an oil-soluble iron compound and an over-based magnesium compound to liquid petroleum fuel.

14 Claims, No Drawings

METHOD OF REDUCING SMOKE AND PARTICULATE EMISSIONS FROM SPARK-IGNITED RECIPROCATING ENGINES OPERATING ON LIQUID PETROLEUM FUELS

RELATED APPLICATIONS

This application claims the benefit of provisional application with the U.S. Ser. No. 60/373,249, filed on Apr. 17, 2002, which hereby is incorporated by reference in its entirety.

BACKGROUND OF THE INVENTION

1. Technical Field

The present invention relates in general to a fuel additive that is a combustion catalyst for gasoline and in particular to a catalyst containing an over-based magnesium compound combined with a soluble iron compound. Such catalyst is particularly useful in spark-ignited reciprocating engines operating on gasoline fuel. The catalyst increases the RON or Research Octane Number of the naphtha feed stocks derived from petroleum used to formulate gasoline.

2. Description of the Prior Art

Refining of petroleum consists principally of separating fractions of the oil according to distillation fractions. Following removal of gas, the first boiling fraction is No. 1 fuel or naphtha. The next fraction, No. 2 fuel, is up to the limit of atmospheric distillation. This fraction includes gasoline fuel, kerosene and jet fuels. No. 4 fuel is the portion distilled under vacuum. No. 6 fuel is the residual fuel left behind following vacuum distillation. (No. 3 and No. 5 are usually mixtures.)

The naphtha fraction contains a wide range of molecular structures with low-molecular weight. Some of these structures yield high octane numbers and other structures low octane. During most of the $20^{th}$ century, a large amount of the portion with low octane number could be used with octane enhancing products.

Many chemical compounds have been used over the past century to improve octane number as engine efficiencies have increased with higher compression ratios. The use, and subsequent banning, of lead has been known for a long time. Tetraethyl lead showed a positive effect on octane and a profoundly negative effect on the environment.

Catalytic cracking will accomplish the same result of increasing octane number, but with an enormous fixed cost in equipment. Catalytic cracking of residual fuel has been used to increase the volume of high octane naphtha grade fuels. These processes are extremely efficient leading to 40% or more of the barrel of crude available for use as gasoline.

In addition to tetraethyl lead, several elements are known to have combustion catalyst characteristics. Examples, in addition to lead, are manganese, iron, copper, cerium, calcium and barium. Each of these elements has advantages and disadvantages in particular applications.

In the past, iron has been evaluated, mainly in the form of bis-cyclopentadienyl iron (0) or ferrocene. Drawbacks of ferrocene include limited solubility in gasoline, toxicity, and expense as an additive. Other iron compounds in oil soluble form or as dispersions have been evaluated with similar drawbacks of toxicity and expense. Iron products typically increase RON by about 2 units. However, iron compounds typically react with sulfur in the naphtha feed stock to form iron sulfide precipitate, which is undesirable.

Another commonly-used additive in gasoline is MTBE. While this compound boosts octane levels significantly, the compound is thought to be carcinogenic. Also, it mixes easily with water which is hazardous should there be a leak. Gasoline containing MTBE leaking from an underground tank at a gas station could potentially leach into groundwater and contaminate wells. As a result of the believed negative potential of MTBE on the environment, ethanol is also being evaluated as a gasoline additive to boost octane.

The effects of various metals listed above are known to improve combustion in boilers and combustion turbines and metals but these metals are known to vary ash quality. In addition to iron, useful first row transition metals from the periodic table include manganese and copper. Also, various alkaline earth metals (barium, calcium) and others such as cerium, platinum and palladium have been tested. Manganese is most widely used as a combustion catalyst in boilers with residual oil that often contains fuel contaminants, such as vanadium. Platinum and palladium, generally found in catalytic converters, are quite expensive. Manganese, when used alone, also forms low melting deposits and negates effects of magnesium on control of vanadium/sodium/calcium/potassium deposits. Iron catalyzes sulfur trioxide formation from sulfur dioxide increasing "cold end" corrosion (exhaust area) and sulfuric acid "rain" problems. Copper is less effective than either iron or manganese. Calcium forms tenacious deposits with other contaminant metals. Barium forms toxic salts. Cerium is not considered effective because of its higher elemental weight. These metals have been demonstrated to reduce smoke by no more than 50% at concentrations of up to about 50 PPM on a weight/weight basis by Environmental Protection Agency Test Method 5 (EPC M-5). While these metals have been evaluated in turbines and boilers, octane number is not at issue in this environment. Stability of the metal molecules is also not at issue and therefore not tested in boiler and turbines.

In addition to the industry goal of improved combustion efficiency, smoke emissions reduction is also a concern. The industry has not made substantial progress on development of a fuel additive for reducing smoke and particulate emissions from high speed (>1,000 rpm), high-compression reciprocating spark-ignited engines, such as gasoline engines. In some countries, gasoline containing as much as 5,000 ppm or more sulfur, compared with 1,500 ppm limit in the United States. This presents a problem with sulfur oxide emissions that deteriorate the exhaust catalyst system and emit large amounts of harmful sulfur compounds into the atmosphere. We have found that the additive described in this patent application significantly reduces sulfur emissions in spark-ignited reciprocating engine exhausts, especially high-compression, high-performance, fuel-injected, computer-controlled engines.

Marine engines, which are substantially different in design and fuel type from spark-ignited engines, have been the subject of research on additives to reduce smoke emissions. Dispersion-type manganese (Mn) and iron (Fe) compounds have been used individually and in combination to reduce smoke emissions in low-speed (150–400 rpm) marine diesel engines. However, these compounds produce solid material in the gaseous phase. Marine diesel engines are capable of tolerating such gaseous phase solid materials because such engines have large piston and bore size tolerances as compared with higher speed gasoline engines. Moreover, marine diesel engines consume large amounts of crankcase oil in the combustion process, which may help to reduce solid material accumulation. Medium (450–1,000 rpm) and high speed (>1,000 rpm) engines cannot tolerate high levels of contamination of crankcase oil from combustion products. However, dispersion-type manganese and iron compounds have not been shown to have any synergistic relationship for combustion catalysis.

Over-based magnesium (Mg) compounds are known in the art for converting trace metal contaminants into high melting compounds and reducing deposits in combustion turbine engines operated by liquid petroleum fuels containing trace metal contaminants such as vanadium, lead, sodium, potassium and calcium. These contaminants form low melting point corrosive deposits on hot metal parts in reciprocating engines, such as low-speed marine diesel engines. Magnesium is known to form high-melting salts with vanadium, sodium and other fuel contaminants. As a result, over-based magnesium compounds are used alone as fuel additives for compression-ignited reciprocating engines to reduce the effects of these contaminants. For example, an over-based magnesium compound has been used alone in a Wartsilla V32 18 cylinder 8 MW stationary diesel engine, to alleviate the effects of deposits and corrosion from the residual oil fuel used. However, there are no known magnesium-containing fuel additives for gasoline engines, which reduce smoke and particulate emissions.

A fuel additive that includes a combustion catalyst to reduce smoke and particulate emissions from bus, truck and automobile gasoline engines operating on gasoline fuels would be advantageous. Also advantageous would be a fuel additive that increases the octane number of fuel, in particular, gasoline. It would be advantageous to reduce smoke, sulfur and nitrogen emissions. Likewise, it would be advantageous to create a non-cracking method and additive for the treatment of high sulfur naphtha feed stocks, such as that found in Saudi Arabia. An additive that does not result in the formation of precipitates would be also advantageous. An additive for hydrocarbon fuel that reduces level of NOx produced would also be advantageous. Finally, a soluble iron additive that remains stable during the combustion process would be advantageous. It is well known that iron reacts with inorganic sulfides and mercaptans (organic sulfur containing compounds) to form iron sulfide.

SUMMARY OF INVENTION

The present invention includes a method and additive for reducing smoke and particulate emissions from spark-ignited reciprocating engines, such as gasoline engines, operating on a liquid petroleum fuel such as gasoline. The method includes adding the fuel additive to the liquid petroleum fuel for use in a spark-ignited reciprocating engine. The additive contains an oil-soluble iron compound and an over-based magnesium compound. The term "over-based" is defined below. In this form, the fuel additive preferably shows a ratio of 5:1 iron to magnesium on a weight basis. This is a weight ratio of iron to magnesium metal. A preferred embodiment includes the additive containing from about 3 parts to about 8 parts iron per about 1 part magnesium, by weight. Alternately, the fuel additive contains from about 4 parts to about 7 parts iron per about 1 part magnesium. When the fuel additive is added to the liquid petroleum fuel, the iron content is preferably in the range of 30–70 PPM by weight with 50 PPM being particularly preferred. Smoke and particulate emissions from gasoline engines are reduced by more than 90 percent using the composition and method of this invention. A 10% or more fuel efficiency increase and RON increase of 3 or more is achieved.

In a preferred embodiment, the oil-soluble iron compound is ferric carboxylate such as ferric naphthenate or iron naphtenate salt.

The additive is suitable for use in spark-ignited reciprocating engines such as gasoline engines which operate at about 400 to 1,000 rpm to about 1,000 to 6500 rpm.

The invention includes a method of catalyzing combustion of a liquid petroleum fuel in a spark-ignited reciprocating engine including adding an oil-soluble iron compound and an over-based magnesium compound to the liquid petroleum fuel; and whereby the engine has improved engine performance, increased engine horsepower produced and increased fuel efficiency. A process for creating ferric naphthenate of high purity suitable for use in creation of the additive includes heating iron oxide to a temperature above about 300 degrees C. in the presence of naphthenic acid and acetic acid.

Use of the additive of the invention in hydrocarbons to be combusted also is a method of reducing NOx emissions from hydrocarbon-burning processes.

DETAILED DESCRIPTION OF THE PREFERRED EMBODIMENT OF THE PRESENT INVENTION

It has been shown that iron behaves as a true catalyst based on kinetic theory. In related works of this author, including U.S. patent application Ser. No. 10/192,261, it has been found that oil-soluble iron combined with oil-soluble magnesium is a very effective combustion catalyst in compression-ignited (Diesel) reciprocating engines. The synergistic mixture of metals results in suppression of hydrocarbons in the exhaust (soot or smoke) and 8 to 12% increase in fuel efficiency.

It has been determined that this novel combination of iron and magnesium in naphtha based fuels (gasoline) yields an unexpected increase in RON of 3 or more units. It has also been found that the iron compound employed in this product does not disassociate or form iron sulfides. This observation is entirely unexpected as iron compounds typically exhibit negative side effects as discussed above. It appears that catalysis occurs from release of energy by electrons decaying from highly energized to, degenerate orbitals. This is observed in the emission spectra of the element. An examination of the emission spectra of iron and magnesium demonstrates a reinforcement of the energy by non-duplicated primary spectra lines. It is believed that the mechanism of catalysis is that the reaction of hydrocarbon with oxygen to form carbon dioxide and water is rapidly quenched by dilution with air and reduced temperature. The energy from decaying electrons in the metal catalyst re-energizes the reaction process so that combustion is completed. This results in lower temperatures of operation and reduced NOx formation. The MgO is broken down to an average particle size of 0.3–0.5 millimicrons. It is surrounded by and partially reacted with the long chain lipophillic organic acid creating a micelle. The micelle is dispersed/dissolved in the hydrocarbon solvent leading to an oil-soluble colloidal dispersion.

The preferred iron compound used in the formulation is ferric naphthenate. Naphthenic acid is an aliphatic carboxylic acid with a phenyl group on the end of the chain opposite the carboxyl group. Iron oxide is reacted therewith to create ferric naphthenate. The unsaturated ring will cause higher electron density in the carboxyl group with a lower ionization constant. The result is that the iron naphthenate does not disassociate readily in a hydrocarbon system, even in the presence of a strong Lewis acid such as a sulfide ion. The addition of this additive allows the use of cheaper grades of gasoline as these gasolines can be significantly improved and made useable by such addition, especially gasoline containing up to 5,000 ppm sulfur and higher.

The additive of the invention also eliminates NOx formation as the fuel, without special adaptations, will burn at a lower temperature creating fewer pollutants. While catalytic converters are required in vehicles, the use of a catalytic converter is made redundant through the additive as the additive alone reduces pollutants without the concurrent creation of NOx associated with higher temperatures.

Oil-soluble organic iron and magnesium compounds reduce smoke emission from combustion turbine exhausts by up to 80% at iron concentrations of up to 30 PPM when such engines are operated on liquid petroleum fuels. This has been demonstrated in a combustion turbine engine, such as a Westinghouse Model 501-F 150 MW engine. Combustion turbine engines are known to produce an excessive amount of smoke emissions and particulate matter during the start-up cycle due to unstable combustion. This may be due to large-sized fuel droplets resulting in inefficient combustion. An iron oxide dispersion product is known to reduce smoke emissions in combustion turbine engines, along with the negative side effects noted above. The dispersion product reached maximum smoke reduction at 55 PPM iron (Fe) as compared with the oil-soluble iron and magnesium additive that reached a maximum reduction at 30 PPM Fe. This may be attributable to the difference between an oil-soluble solution of the iron product at the molecular level compared with a dispersion product having an average particle size of 0.05 to 0.5 micrometer. Spark-ignited engines benefit from oil-soluble additive because of sensitivity of fuel injection systems to particle size of dispersion type products.

The very high activity of the iron-magnesium combination was entirely unexpected, especially at the 50 PPM iron (Fe) treatment level. An examination of the spectra of magnesium, iron, copper and manganese reveals that the spectra lines of magnesium compliment the spectra lines of iron. There are no duplicates or reinforcements. The magnesium spectra, by itself, do not yield energy in the areas that will continue burning of hydrocarbons after the temperature is quenched. However, it is believed that the magnesium spectra are synergistic with the spectra of iron to give an energy quanta (packets) that support and continue reaction of hydrocarbon with oxygen after the temperature is quenched below temperatures that would normally support combustion. Therefore, magnesium supports the catalytic effect of iron in a synergistic fashion that results in the additive being much more effective than iron alone. The longer burning time results in cooler temperatures resulting in lower NOx formation.

The composition of one embodiment of this invention is an oil-soluble iron compound and an over-based magnesium compound. This composition catalyzes combustion of liquid petroleum fuels in spark-ignited reciprocating engine, such as gasoline engines, when added to such fuels. The catalyzed combustion results in improved engine performance, increased engine horsepower produced and increased fuel efficiency. The additive is immediately soluble in the fuel. The additive is designed with viscosity and density similar to the fuel for miscibility. The additive can be added to the fuel tank as the tank is filled, such as an octane booster. It is more efficient to add at a bulk station with concentrated additive. Field tests indicate no deleterious effects of the additive on fuel stability. Thus, the treated fuel can advantageously be sent through pipelines.

The additive has been tested and found to be effective with iron to magnesium around a preferred ratio of 5:1 by weight and is useful in a range of 3 parts to about 8 parts iron per about 1 part magnesium. A preferred embodiment includes magnesium preferably between 0.1 and 3 in this ratio to iron. We have tested at the following ratios of Fe/Mg: Infinite (i.e. Mg=0), 5:1, 1:5 and 7.5:1. Outstanding results in field tests, particularly with the 5:1 ratio in reciprocating engines, have been achieved.

The method of reducing smoke and particulate emissions from an exhaust gas from a spark-ignited reciprocating engine operating on a liquid petroleum fuel includes adding a fuel additive to the liquid petroleum fuel, the fuel additive comprises a oil-soluble iron compound and an over-based magnesium compound.

The composition of this invention includes a fuel additive, which contains about 3.0 to 8.0 parts iron, by weight for about 1.0 part magnesium, by weight. Preferably, from 4.0 to about 7.0 parts iron, by weight, for 1.0 part magnesium, by weight. More preferably, from about 5.0 parts iron, by weight, for about 1 part magnesium, by weight.

The preferred over-based magnesium compounds of this invention are selected from carboxylate, sulfonate, acetic and mixtures thereof The term "over-based" refers to the excess amount of base as compared with the acid of the solution, the acid being provided by the carboxylic acid, sulfonic acid or acetic acid of the preferred embodiment. The over-based magnesium compound preferred for this invention is magnesium oxide in a stable colloidal dispersion, the magnesium oxide being in such a proportion as to be greater than the amount that the acid of the additive solution could neutralize. There are a number of companies that manufacture over-based oil-soluble magnesium. Examples are: SFA International, Baker-Petrolite, Lubrizol, Crompton-Knowles, LMG Group Inc. The inorganic molecular moiety can be magnesium oxide or carbonate.

EXAMPLE 1

The fuel additive composition can be formulated as a concentrate, which preferably contains about 5.5% iron, by weight, and about 1.1% magnesium, by weight. Dilutions of this concentrate can be made for convenience of use.

To treat 100 liters of gasoline fuel, the weight of the gasoline fuel to be treated is 80 kg, based on a density of 0.8 gm/cc. For an iron concentration of 50 PPM Fe, the amount of oil-soluble iron needed is about 4 gm. Fe. Sufficient oil-soluble iron and over-based magnesium compounds are added to the fuel so that about 4 gm. of iron are added for about 100 liters of fuel.

Other volumes and/or weights may be used to treat a given volume and/or weight of fuel with an variety of concentration of the fuel additive. This fuel additive has been tested in passenger vehicles having gasoline engines, such as a pickup truck, a minivan, and in commercial vehicles, such as intra- and inter-city buses and over-the road trucks.

EXAMPLE 2

The oil-soluble iron compound of this invention may be prepared in a single batch in laboratory quantities. The apparatus required is a 3-Neck round bottom 1,000 ml. flask, heating mantle, temperature controller, 0–400° C. thermometer, stirrer center mounted with a motor and controller, condenser and vacuum pump with trap.

The reactants are as follows:

| | |
|---|---|
| Iron Oxide | 79 gms. |
| Carboxylic acid (MW > 200) | 720 gms |
| High Boiling Process Solvent | 215 gms |

The apparatus is assembled with the thermometer in one outside neck and stirrer in the center. Connect a condenser to the flask in the reflux position. Add high boiling solvent, carboxylic acid (>200 MW) to the reactor. Heat to 90° C. Add iron oxide and heat to 110° C. Add carboxylic acid (>45 MW) and heat to 140° C. Reflux for one hour. Remove water of reaction with the carboxylic acid. Heat to >200° C. until high boiling solvent and water is removed. When water stops evolving, place the condenser in the distillation position, apply vacuum and remove remaining solvent. Return high boiling solvent and/or HAN or No. 2 fuel to reach desired iron concentration.

EXAMPLE 3

The over-based magnesium compound of this invention may be prepared in a single batch in laboratory quantities. The apparatus required is a 3-Neck round bottom 1,000 ml. flask, heating mantle, temperature controller, 0–400° C. thermometer, center-mounted stirrer with a motor and controller, condenser and vacuum pump with trap.

The reactants are as follows:

| | |
|---|---|
| Magnesium hydroxide | 195 gms. |
| Sulfonic acid (MW > 200) | 37 gms. |
| Carboxylic acid (MW > 200) | 99 gms. |
| Carboxylic acid (MW > 45) | 2 gms. |
| High Boiling Process Solvent | 215 gms. |
| High aromatic solvent | 138 gms. |

The apparatus is assembled with the thermometer in one outside neck, stirrer in the center. Connect the condenser to the flask in the reflux position. Add high boiling solvent, carboxylic acid (>200 MW) and sulfonic acid to the reactor. Heat to 90° C. Add magnesium hydroxide and heat to 110° C. Add carboxylic acid (>45 MW) and heat to 140° C. Reflux for one hour. Remove water of reaction with the carboxylic acids. Heat to >280° C. until high boiling solvent and water is removed. When water stops evolving, place the condenser in the distillation position, apply vacuum and remove remaining solvent. Return high boiling solvent and/or HAN or No. 2 fuel to reach desired magnesium concentration.

While the degree of purity of the additive has not been examined for effect, the additive was created as described above to achieve high purity for purposes of scientific testing. The described method of creating the ferric naphthenate was developed as part of the creation of the fuel additive of the invention and is novel.

The present invention has several advantages. Smoke and particulate emissions from spark-ignited reciprocating engines are reduced by over about 90%, based on visual observations, using the method and oil-soluble iron and over-based magnesium composition of this invention. Spark-ignited reciprocating engines, which use the method and composition of this invention also, produced increased horsepower during vehicle acceleration and operate more smoothly with less vibration and "knocking". Further, the fuel efficiency of such engines also increased from a minimum of 10% to as much as a 20%. In empirical field tests, there has been no evidence of maintenance problems or damage to the engine as a result of using the fuel additive containing the composition of this invention.

To use the additive, a mixture is formed with the gasoline or other fuel prior to combustion. Any traditional method of adding the additive is encompassed herewith. For example, the additive can be added in-line as the fuel is pumped to the engine. This typically requires accurate metering pumps that change pumping rate with fuel use. A more common method is mixing the additive into the fuel, such as gasoline, at any point following refining up to the final fuel tank. Alternately, a consumer can choose to add the fuel additive directly.

This invention avoids the use of toxic metals such as lead in engine exhausts. Ferric oxide resulting from combustion of the additive is rust, a widely prevalent material in nature that is totally benign to biological life forms. Ferric sulfide precipitate is also avoided. The iron naphthenate and the magnesium oxide combination is non-toxic and non-carcinogenic in normal applications. While ingestion and prolonged contact with skin is not recommended, the material can be washed off skin with soap and water, and safely eliminated from the body with emetics. Other methods of practicing the invention would be other chemical forms of the product and introducing to the fuel through different techniques.

While the present invention has been described and/or illustrated with particular reference to a fuel additive that is a combustion catalyst for spark-ignited reciprocating engines, such as gasoline engines operating on liquid petroleum fuels, it is noted that the scope of the present invention is not restricted to the particular embodiment(s) described. It should be apparent to those skilled in the art that the scope of the invention includes the use of the fuel additive in other reciprocating engines than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A method of reducing smoke and particulate emissions from an exhaust gas from a spark-ignited reciprocating engine operating on a liquid petroleum fuel, comprising the step of: adding a fuel additive to the liquid petroleum fuel, the fuel additive comprises:

an oil-soluble iron compound wherein the oil-soluble iron compound comprises ferric naphthenate or iron naphtenate salt; and an over-based magnesium compound.

2. The method of claim 1 wherein the fuel additive contains from about 3 parts to about 8 parts iron per about 1 part magnesium, by weight.

3. The method of claim 1 wherein the fuel additive contains from about 4 parts to about 7 parts iron per about 1 part magnesium, by weight.

4. The method of claim 1 wherein the fuel additive contains about 5 parts iron per about 1 part magnesium, by weight.

5. The method of claim 1 wherein the liquid petroleum fuel contains about 50 PPM of iron, based on weight, after adding the fuel additive.

6. The method of claim 1 wherein the smoke and particulate matter in the exhaust gas is reduced by at least 90 percent by weight.

7. The method of claim 1 wherein the spark-ignited reciprocating engine is a gasoline engine which operate at about 400 to 1,000 rpm to about 1,000 to 6500 rpm.

8. A method of catalyzing combustion of a liquid petroleum fuel in a spark-ignited reciprocating engine, comprising the step of:

adding an oil-soluble iron compound and an over-based magnesium compound to the liquid petroleum fuel; wherein the oil-soluble iron compound comprises ferric naphthenate or iron naphtenate salt; and whereby the engine has improved engine performance, increased engine horsepower produced and increased fuel efficiency.

9. An additive for liquid petroleum fuel for use in a spark-ignited reciprocating engine that produced an exhaust gas, the additive comprising:

a combination of an oil-soluble iron compound and an over-based magnesium compound wherein the oil-soluble iron compound comprises ferric naphthenate or iron naphtenate salt;

the combination operable to reduce smoke from the spark-ignited reciprocating engine when an effective amount of the combination is introduced into the liquid petroleum fuel for use in the spark-ignited reciprocating engine; and the combination further operable to reduce particle emissions from the exhaust gas of the spark-ignited reciprocating engine when an effective amount of the combination is introduced into the liquid petroleum fuel for use in the spark-ignited reciprocating engine.

10. The additive of claim 9 wherein the additive contains from about 3 parts to about 8 parts iron per about 1 part magnesium by weight.

11. The additive of claim 9 wherein the additive contains from about 4 parts to about 7 parts iron per about 1 part magnesium by weight.

12. The additive of claim 9 wherein the additive contains from about 5 parts iron per about 1 part magnesium by weight.

13. The additive of claim 9 wherein the additive is operable to reduce smoke and particulate matter in the exhaust gas by at least 90 percent by weight.

14. The additive of claim 9, wherein the over-based magnesium compound is selected from the group consisting of oxide, carboxylate, sulfonate and mixtures thereof.

* * * * *